US009174136B2

(12) United States Patent
Priest

(10) Patent No.: US 9,174,136 B2
(45) Date of Patent: Nov. 3, 2015

(54) SWING SPRING

(71) Applicant: DDI, Inc., Dubuque, IA (US)

(72) Inventor: John Brian Priest, Dubuque, IA (US)

(73) Assignee: M&M Sales Enterprises Inc., Dubuque, IA (US)

( * ) Notice: Subject to any disclaimer, the term of this patent is extended or adjusted under 35 U.S.C. 154(b) by 25 days.

(21) Appl. No.: 14/104,815

(22) Filed: Dec. 12, 2013

(65) Prior Publication Data

US 2014/0162797 A1 Jun. 12, 2014

Related U.S. Application Data

(60) Provisional application No. 61/736,280, filed on Dec. 12, 2012.

(51) Int. Cl.

| | |
|---|---|
| ***A63G 9/14*** | (2006.01) |
| *A47D 13/00* | (2006.01) |
| *A63G 9/10* | (2006.01) |

(52) U.S. Cl.

CPC .... *A63G 9/14* (2013.01); *A63G 9/10* (2013.01)

(58) Field of Classification Search

CPC ..... A47D 13/00; A47D 13/107; F16R 15/00; F16R 15/022; F16R 1/00; F16R 1/128; F16R 13/00; F16R 13/007; H01R 13/00; H01R 13/107

USPC ..... 472/118–125; 267/33, 69, 70, 71, 131, 267/174

See application file for complete search history.

(56) References Cited

U.S. PATENT DOCUMENTS

| | | | | |
|---|---|---|---|---|
| 1,756,413 | A | 7/1928 | Wilke et al. | |
| 2,957,667 | A * | 10/1960 | Kughler | 248/339 |
| 2,995,327 | A * | 8/1961 | Wood | 248/543 |
| 3,186,711 | A | 6/1965 | Morrow | |
| 3,256,016 | A | 6/1966 | Berlin | |
| 4,138,104 | A | 2/1979 | D'Amicis | |
| 4,681,303 | A * | 7/1987 | Grassano | 267/113 |
| 5,342,245 | A | 8/1994 | Webb, Jr. | |
| 5,624,321 | A | 4/1997 | Snyder | |
| 6,994,630 | B2 * | 2/2006 | Paesang | 472/118 |

* cited by examiner

*Primary Examiner* — Kien Nguyen
(74) *Attorney, Agent, or Firm* — Rathe Lindenbaum LLP

(57) ABSTRACT

A swing spring comprises a first plate or top, a second plate or bottom, guide rods extending between and connected to the first plate and the second plate, a third slider or slider plate slidable along an axis along the guide rods between the first plate and the second plate, a compression spring captured between the third plate and the second plate, a first hook rotatably coupled to the first plate by a thrust bearing and extending in a first direction along the axis, and a second hook coupled to the third plate and extending in a second direction opposite the first direction through the second plate.

20 Claims, 6 Drawing Sheets

SWING SPRING

CROSS-REFERENCE TO RELATED PATENT APPLICATIONS

The present application is a non-provisional application claiming priority from U.S. Provisional Application Ser. No. 61/736,280 filed on Dec. 12, 2012 by John Brian Priest and entitled SWING SPRING, the full disclosure of which is hereby incorporated by reference.

BACKGROUND

Playground and recreational swings typically swing to and fro. Some swings additionally include a spring that allows the swing to resiliently move up and down or bounce. Such existing springs may inhibit the ability of the swing to spin about a vertical axis, often experience high degrees of friction and binding, and may generate undesirable levels of noise.

DETAILED DESCRIPTION OF THE EXAMPLE EMBODIMENTS

Figure 1:
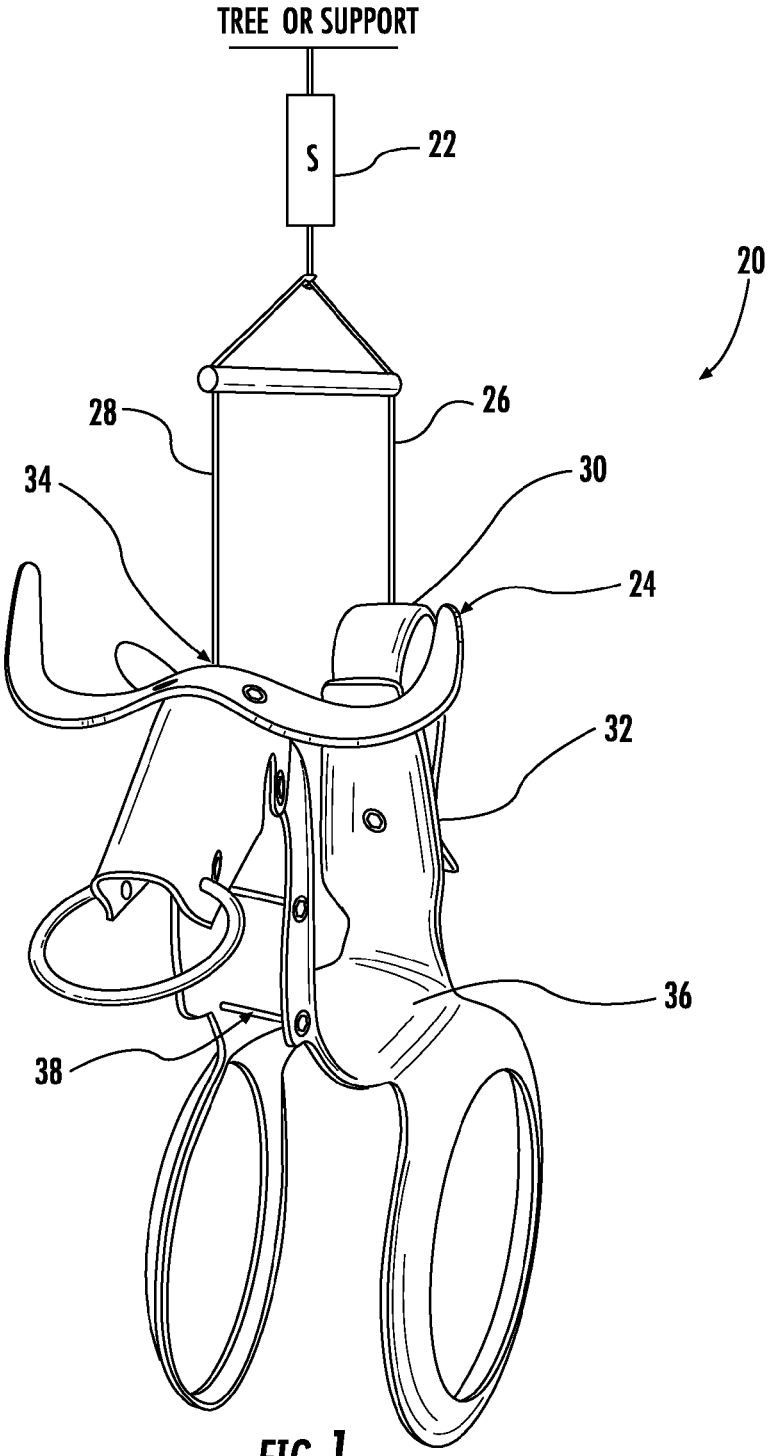
FIG. 1 is a first perspective view of an example swing and spring system.
Figure 2:
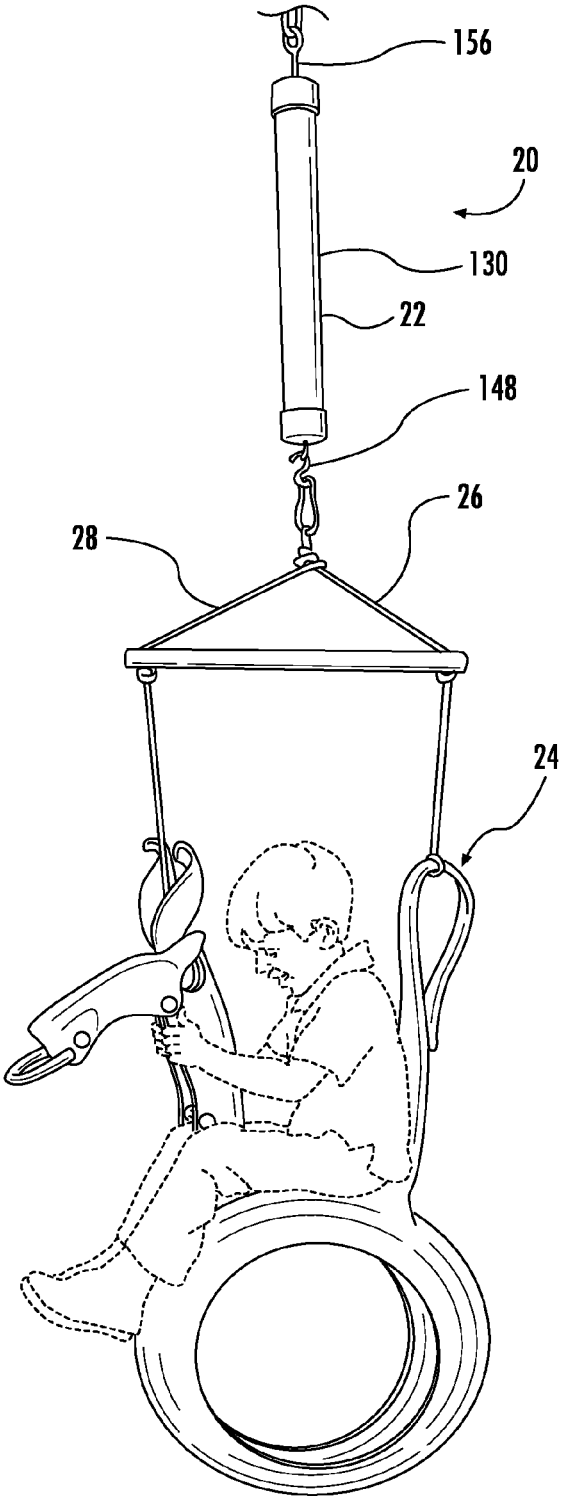
FIG. 2 is a second perspective view of the swing and spring system of FIG. 1.

FIGS. 1 and 2 illustrate an example swing and spring system 20 comprising spring 22 and swing 24. As will be described hereafter, spring 22 allows swing 24 two swing to and fro will also resiliently moving up and down or bounce. Spring 22 facilitates rotation of swing 24 about a vertical axis and provides bounce with lower levels of friction, binding and noise as compared to many existing swing springs.

Spring 22 provides swing 24 with resilient up-and-down movement or bounce. Spring 22 is located between a tree or support and the swing 24. In particular, swing 24 comprises two lines 26, 28, wherein a first line 26 is connected to the rear connection point 30 of the swing seating structure 32 and wherein the second line 28 is connected to the forward connection point 34. The ends of the first and second lines 26, 28 pass through the seating structure 32 and are tied in a knot. As illustrated by FIG. 1, the rear connection point 30 and the forward connection point 34 are not part of the seating structure 30 and are remote from the actual seating surface 36, located above seating surface 36. Seating surface 36 is at least partially shaped or formed by one or more bolts 38 which provide the rubber material of the tire with rigidity in regions of the seat to support the shape of the seat provided by seating surface 36.

Although the swing seating structure 32 is shown as a tire swing in the form of a bull, in other implementations, the swing seating structure 32 may have other configurations formed from a tire, such as other figures including, but not limited to a motorcycle, tractor, deer, pony and the like. In yet other implementations, swing seating structure 32 may alternatively comprise an annular, substantially unaltered tire or wheel suspended in a vertical or a horizontal orientation, a disk or the like. In some implementations, the swing seating structure 32 may comprise a belt or other seating structure suspended from two lines, wherein each line is provided with a spring 22.

Figure 3:
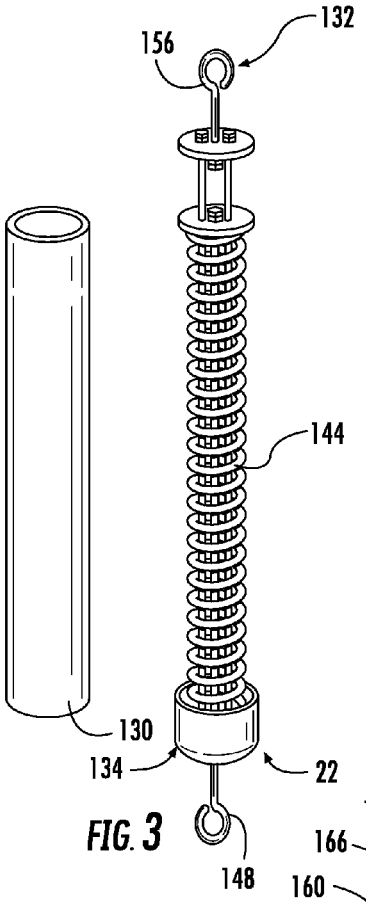
FIG. 3 is an exploded perspective view of a spring of the system of FIG. 1.
Figure 4:
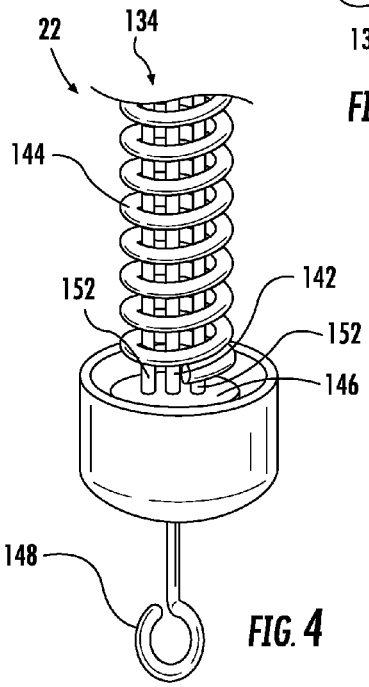
FIG. 4 is an enlarged fragmentary perspective view of a bottom of the spring of FIG. 3.
Figure 5:
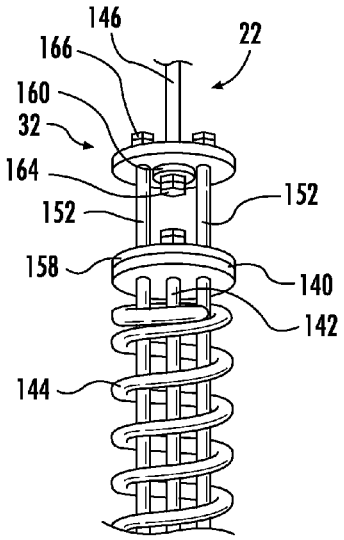
FIG. 5 is an enlarged fragmentary perspective view of a top of the spring of FIG. 3.
Figure 6:
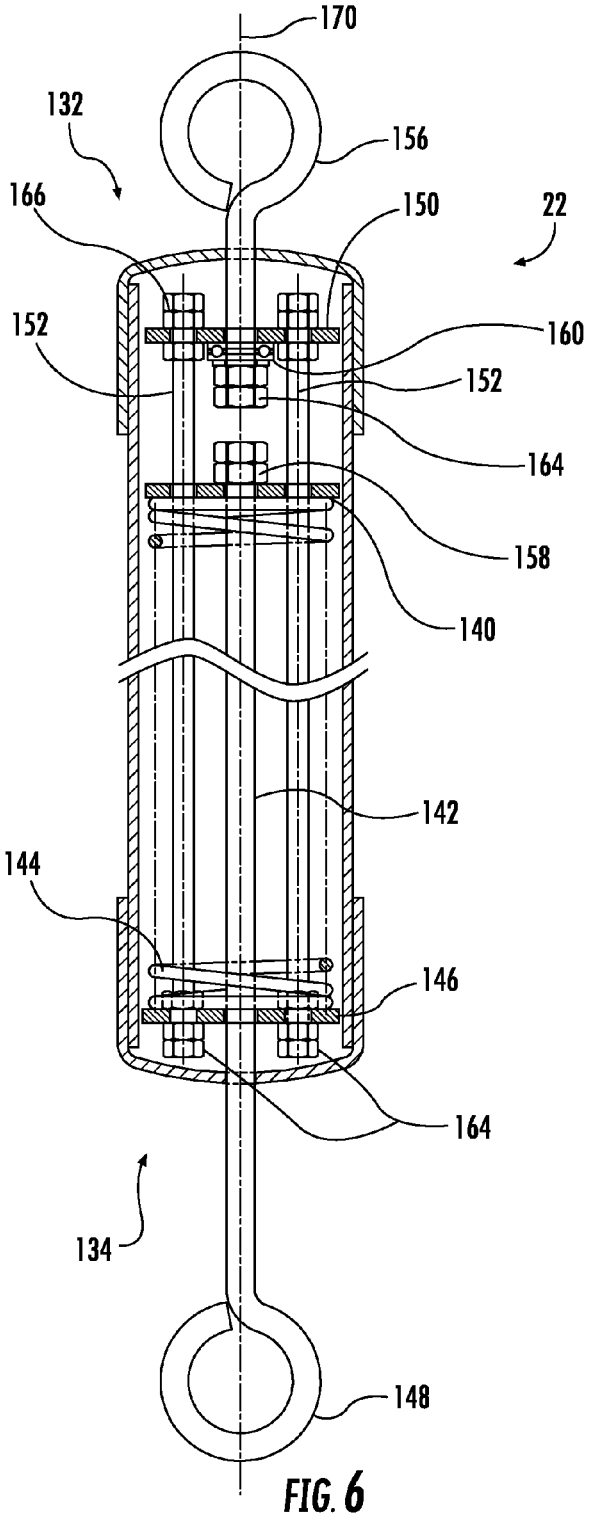
FIG. 6 is a sectional view of the spring of FIG. 1.

FIG. 3-6 illustrate spring 22 in more detail. FIG. 3 illustrates the entire spring 22 with an outer covering tube 130 removed. FIG. 5 illustrates the top 132 of the spring 22 while FIG. 4 illustrates the bottom 134 of the spring 22. FIG. 6 is a sectional view of spring 22 shown in FIGS. 3-5. Spring 22 comprises slider plate 140, rod 142, compression spring 144, lower or bottom plate 146, lower hook 148, upper or top plate 150, guide rods 152 and upper hook 156. Slider plate 140 is slidably supported between bottom plate 146 and top plate 150 by guide rods 152. In the example illustrated, slider plate 140 is formed from a metal, such as aluminum or stainless steel. Slider plate 140 is captured between compression spring 144 and a stop 158, provided by lock nuts secured to rod 142 in the example. Slider plate 140 slides up and down along guide rods 152 during bouncing or upward and downward vertical movement of swing 24 (shown in FIG. 1).

Rod 142 extends from head or stop 158 through slider plate 140, through compression spring 144 and through the lower washer or plate 146 to eyebolt or hook 148 for being connected to the line that is connected to the two lines 26, 28 that are connected to the rear and forward connection points of the swing 24. In the example illustrated, rod 142 is formed from a metal, such as aluminum or stainless steel. Compression spring 144 comprise a compression spring encircling rod 142 and guide rods 152. Compression spring 144 is captured between slider plate 140 and bottom plate 146.

Bottom plate 146 comprises a plate or washer captured between stops or heads 164, provided by lock nuts in the example, and compression spring 144. In other implementations, bottom plate 146 may be welded, bonded or otherwise fixed to a lower end of guide rods 152. Neither slider plate 140 nor the lower washer plate 146 is fixed to the compression spring 144. As shown by the FIG. 4, the lower end of the rod 142 is not attached to the lower washer plate 146, but passes through and is slidable with respect to the lower washer plate 146.

Top washer or plate 150 (formed from a metal in the example implementation) is secured to guide rods 152 which slidably extend through plate 140 and which are connected to plate 146. In the example, plate 150 is secured to guide rods 152 by nuts 166. In other implementations, top plate 150 may be welded, bonded or otherwise fixed to an upper end of guide rods 152. Eyebolt or hook 156 extends through plate 150 and through a one-way thrust bearing 160 and is retained in place by fasteners, such as lock nuts 164. One-way thrust bearing 160 enhances the ability of swing hook 156 and spring 22 (as well as swing 24) to freely spin about axis 170 with reduced friction, reduced noise and reduced binding.

Figure 7:
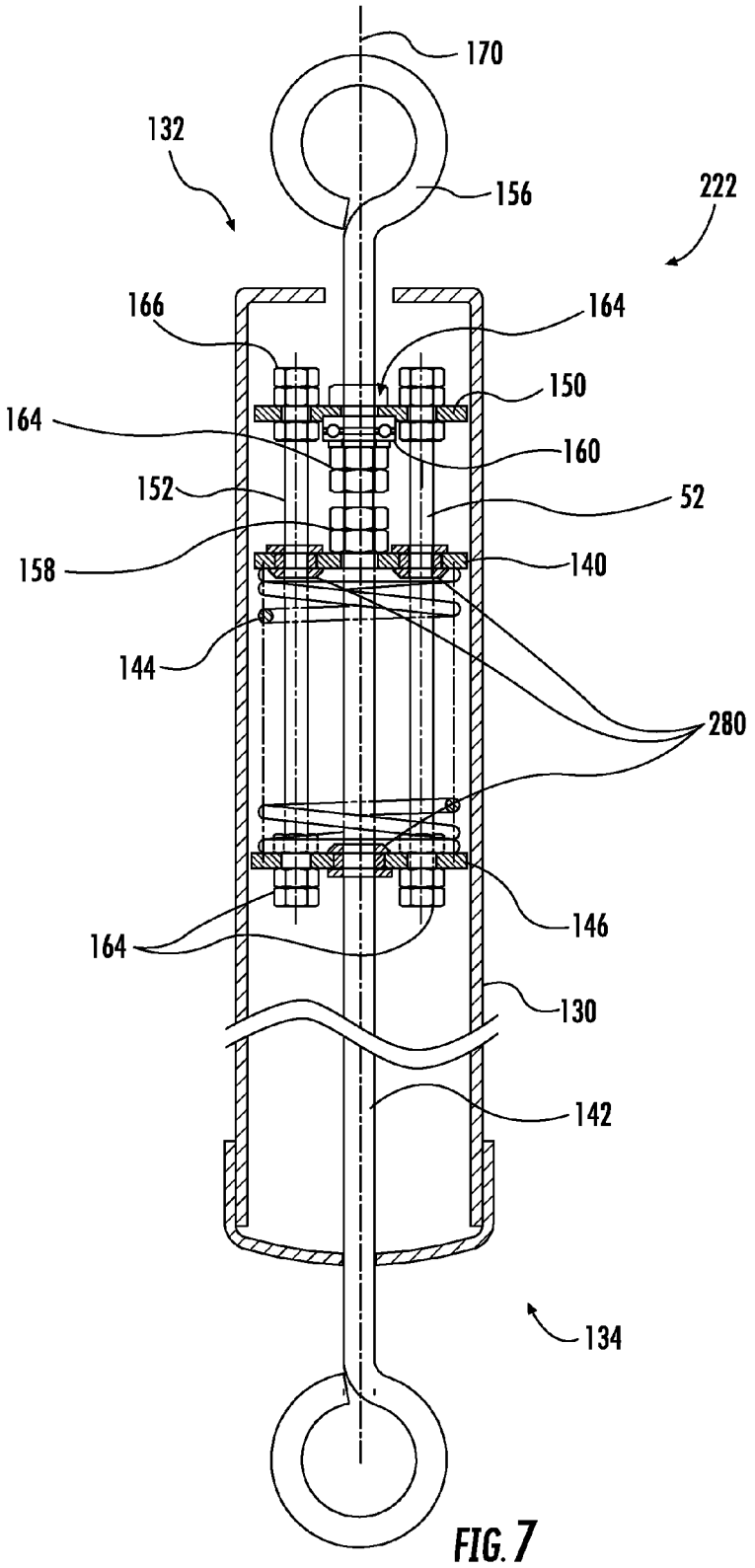
FIG. 7 is a first sectional view of another example spring of the system of FIG. 1.
Figure 8:
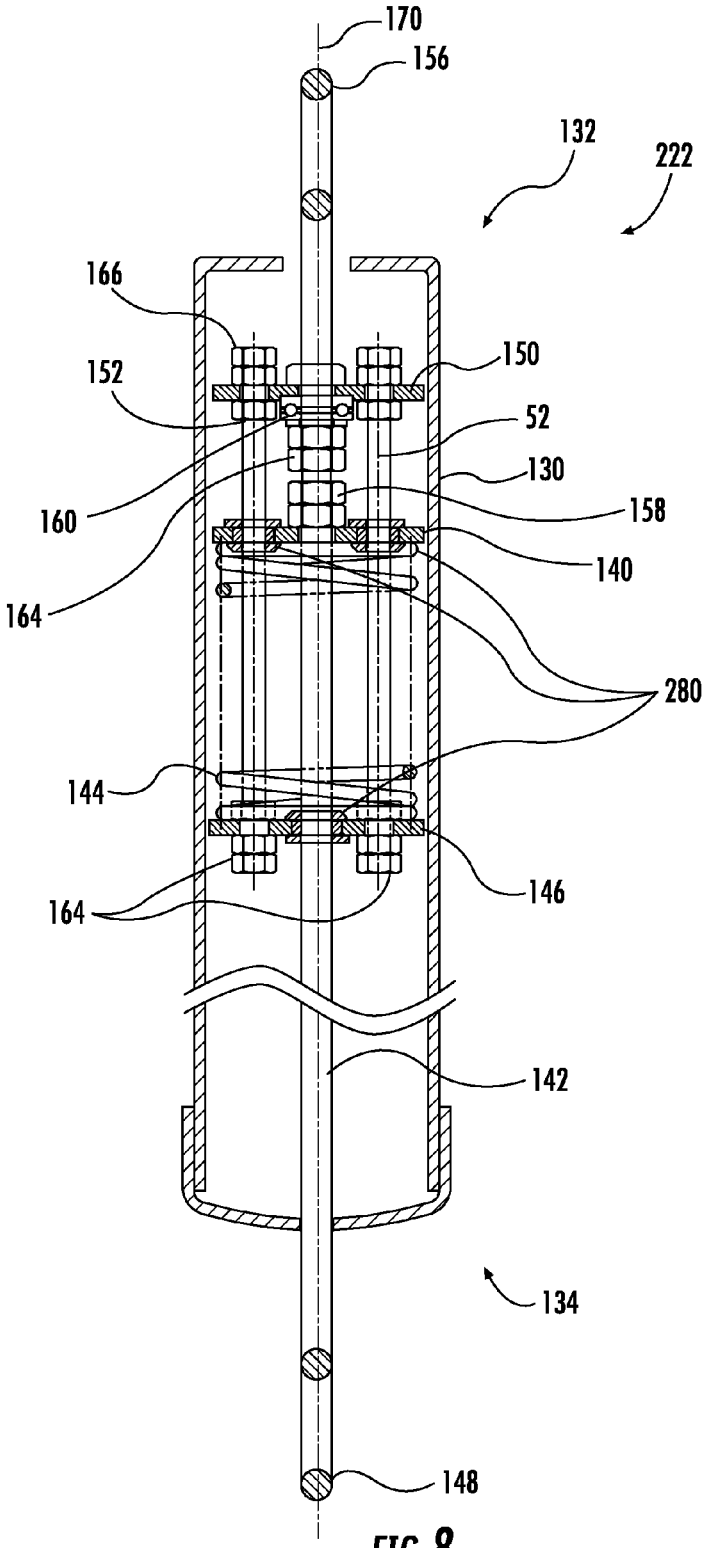
FIG. 8 is a second sectional view of the spring of FIG. 7.

FIGS. 7 and 8 are orthogonal sectional views illustrating spring 222, another example implementation of spring 22. Spring 222 is similar to spring 22 except that spring 222 additionally comprises polymeric, low friction bushings 280 that extend about guide rods 152 between guide rods 152 and plate 140 and that extend about rod 142 between rod 142 and plate 146. Bushings 180 further enhance the ability of swing 24 to rotate about axis 170 and further enhance the ability of swing 24 to bounce, move upwardly and outwardly, all with reduced friction, noise and accidental binding. As a result, spring 222 provides swing 24 with a smoother, more responsive ride.

Although plates 146 and 150 are illustrated as being contained within tubular housing 30, in other implementations, plates 146, 150 may alternatively be provided as part of or alternatively form a bottom and a top, respectively, of tubular housing 30. Although lock nuts 166 and 164 are illustrated as being utilized to secure guide rods 152 to top plate 150 and to secure hook 156 to plate 150, respectively, and although lock nuts 164 are illustrated as being used to contain plate 146 in one direction along guide rods 152, in other implementations, other mechanisms or structures may be utilized. Although spring 222 is illustrated as including two guide rods 152, in other implementations, spring 152 may include greater than two guide rods 152 for slidably guiding slider or slider plate 140.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments.

Because the technology of the present disclosure is relatively complex, not all changes in the technology are foreseeable. The present disclosure described with reference to the example embodiments and set forth in the following definitions is manifestly intended to be as broad as possible. For example, unless specifically otherwise noted, the claims reciting a single particular element also encompass a plurality of such particular elements.

What is claimed is:

1. An apparatus comprising:
a first plate;
a second plate;
guide rods extending between and connected to the first plate and the second plate;
a third plate slidable along an axis along the guide rods between the first plate and the second plate;
a compression spring captured between the third plate and the second plate;
a first hook rotatably coupled to the first plate by a thrust bearing and extending in a first direction along the axis; and
a second hook coupled to the third plate and extending in a second direction opposite the first direction through the second plate.

2. The apparatus of claim 1 further comprising:
first polymeric bushings about the guide rods between the guide rods and the third plate; and
a second polymeric bushing about the second hook between the second hook and the second plate.

3. The apparatus of claim 1 further comprising a tube about the first plate, second plate and the third plate.

4. The apparatus of claim 1 further comprising a swing coupled to the first hook.

5. The apparatus of claim 1, wherein the second plate is slidable along the guide rods and the second hook.

6. The apparatus of claim 1, wherein the second hook extends through the second plate and the third plate.

7. An apparatus comprising:
an elongate housing having a top and a bottom;
guide rods extending between the top and the bottom;
a slider slidable along the guide rods;
a compression spring captured between the slider and the bottom;
a first hook rotatably coupled to the top by thrust bearing and extending upwardly from the top;
a second hook coupled to the slider and slidably extending through the bottom.

8. The apparatus of claim 7, wherein the top comprises a first plate, wherein the bottom comprises a second plate and wherein the slider complies a third plate.

9. The apparatus of claim 8 further comprising:
first polymeric bushings about the guide rods between the guide rods and the third plate; and
a second polymeric bushing about the second hook between the second hook and the second plate.

10. The apparatus of claim 8 further comprising a tube about the first plate, second plate and the third plate.

11. The apparatus of claim 8 further comprising a swing coupled to the first hook.

12. The apparatus of claim 8, wherein the second plate is slidable along the guide rods and the second hook.

13. The apparatus of claim 8, wherein the second hook extends through the second plate and the third plate.

14. An apparatus comprising:
a swing having a seating surface; and
a spring suspending the swing, the spring comprising:
an elongate housing having a top and a bottom;
guide rods extending between the top and the bottom;
a slider slidable along the guide rods;
a compression spring captured between the slider and the bottom;
a first hook rotatably coupled to the top by thrust bearing and extending upwardly from the top;
a second hook coupled to the slider and slidably extending through the bottom.

15. The apparatus of claim 14, wherein the top comprises a first plate, wherein the bottom comprises a second plate and wherein the slider complies a third plate.

16. The apparatus of claim 15 further comprising:
first polymeric bushings about the guide rods between the guide rods and the third plate; and
a second polymeric bushing about the second hook between the second hook and the second plate.

17. The apparatus of claim 15 further comprising a tube about the first plate, second plate and the third plate.

18. The apparatus of claim 15 further comprising a swing coupled to the first hook.

19. The apparatus of claim 15, wherein the second plate is slidable along the guide rods and the second hook.

20. The apparatus of claim 15, wherein the second hook extends through the second plate and the third plate.

* * * * *